US010253657B2

(12) United States Patent
Uckermark et al.

(10) Patent No.: US 10,253,657 B2
(45) Date of Patent: Apr. 9, 2019

(54) SWITCHABLE ROCKER ARM WITH A TRAVEL STOP

(71) Applicant: DELPHI TECHNOLOGIES IP LIMITED, St. Michael (BB)

(72) Inventors: Chad E. Uckermark, Warwick, NY (US); Joseph M. West, Rochester, NY (US)

(73) Assignee: DELPHI TECHNOLOGIES IP LIMITED (BB)

( * ) Notice: Subject to any disclaimer, the term of this patent is extended or adjusted under 35 U.S.C. 154(b) by 88 days.

(21) Appl. No.: 15/437,028

(22) Filed: Feb. 20, 2017

(65) Prior Publication Data

US 2018/0238198 A1 Aug. 23, 2018

(51) Int. Cl.

| | |
|---|---|
| ***F01L 1/18*** | (2006.01) |
| ***F01L 1/047*** | (2006.01) |
| ***F01L 1/20*** | (2006.01) |
| ***F01L 1/46*** | (2006.01) |
| ***F01L 13/00*** | (2006.01) |

(52) U.S. Cl.

CPC ..... *F01L 1/18* (2013.01); *F01L 1/047* (2013.01); *F01L 1/185* (2013.01); *F01L 1/205* (2013.01); *F01L 1/462* (2013.01); *F01L 13/0005* (2013.01); *F01L 13/0015* (2013.01); *F01L 13/0036* (2013.01); *F01L 2001/186* (2013.01); *F01L 2001/467* (2013.01); *F01L 2103/00* (2013.01); *F01L 2105/02* (2013.01); *Y10T 74/20882* (2015.01); *Y10T 74/2107* (2015.01)

(58) Field of Classification Search

CPC ..... F01L 1/18; F01L 13/0015; F01L 1/462; F01L 1/205; F01L 1/047; F01L 13/0005; F01L 2001/186; F01L 2103/00; F01L 2001/467; F01L 1/185; F01L 2105/00; Y10T 74/20882; Y10T 74/2107

See application file for complete search history.

(56) References Cited

U.S. PATENT DOCUMENTS

| | | | | |
|---|---|---|---|---|
| 5,544,626 | A | 8/1996 | Diggs et al. | |
| 5,653,198 | A | 8/1997 | Diggs | |
| 6,314,928 | B1 | 11/2001 | Baraszu et al. | |
| 6,325,030 | B1 * | 12/2001 | Spath | F01L 1/18 123/198 F |
| 6,532,920 | B1 | 3/2003 | Sweetnam et al. | |
| 7,614,375 | B2 | 11/2009 | Tawaf et al. | |
| 7,798,113 | B2 | 9/2010 | Fischer et al. | |

(Continued)

*Primary Examiner* — Mark A Laurenzi
*Assistant Examiner* — Wesley G Harris
(74) *Attorney, Agent, or Firm* — Joshua M. Haines

(57) ABSTRACT

A rocker arm includes an outer arm defining a stop aperture with a stop surface; an inner arm which selectively pivots relative to the outer arm; a latching mechanism which switches the rocker arm between a coupled state in which the inner arm is prevented from pivoting relative to the outer arm in a first direction and a decoupled state in which the inner arm pivots relative to the outer arm; a lost motion spring which biases the inner arm to pivot relative to the outer arm in a second direction which is opposite from the first direction; and a stop pin fixed to the inner arm and extending into the stop aperture such that the stop pin is circumferentially surrounded by the stop surface and such that the stop pin within the stop aperture limits the extent to which the inner arm pivots relative to the outer arm.

9 Claims, 9 Drawing Sheets

(56) References Cited

U.S. PATENT DOCUMENTS

| | | | | |
|---|---|---|---|---|
| 7,882,814 | B2 | 2/2011 | Spath et al. | |
| 2006/0138373 | A1 | 6/2006 | Grethel et al. | |
| 2011/0197843 | A1* | 8/2011 | Manther | F01L 1/185 123/90.45 |
| 2012/0037107 | A1 | 2/2012 | Church | |
| 2012/0266835 | A1* | 10/2012 | Harman | F01L 1/185 123/90.39 |
| 2012/0312264 | A1 | 12/2012 | Mck et al. | |
| 2013/0000582 | A1 | 1/2013 | Church | |
| 2014/0150745 | A1 | 6/2014 | Church | |
| 2015/0135893 | A1* | 5/2015 | Evans | F01L 1/18 74/569 |
| 2015/0345343 | A1 | 12/2015 | Lee et al. | |
| 2015/0377093 | A1 | 12/2015 | Church | |
| 2018/0045081 | A1 | 2/2018 | Rehm et al. | |

* cited by examiner

SWITCHABLE ROCKER ARM WITH A TRAVEL STOP

TECHNICAL FIELD OF INVENTION

The present invention relates to a rocker arm for valve train of an internal combustion engine; more particularly to a rocker arm with an inner arm which selectively pivots relative to an outer arm, and even more particularly to such a rocker arm with a stop pin which limits the extent to which the inner arm pivots relative to the outer arm.

BACKGROUND OF INVENTION

Variable valve activation mechanisms for internal combustion engines are well known. It is known to lower the lift, or even to provide no lift at all, of one or more valves of an internal combustion engine, during periods of light engine load. Such valve deactivation or valve lift switching can substantially improve fuel efficiency.

A rocker arm acts between a rotating eccentric camshaft lobe and a pivot point on the internal combustion engine, such as a hydraulic lash adjuster, to open and close an engine valve. Switchable rocker arms may be a "deactivation" type or a "two-step" type. The term switchable deactivation rocker arm, as used herein, means the switchable rocker arm is capable of switching from a valve lift mode to a no lift mode. The term switchable two-step rocker arm, as used herein, means the switchable rocker arm is capable of switching from a first valve lift mode to a second and lesser valve lift mode, that is greater than no lift. It should be noted that the second valve lift mode may provide one or both of decreased lift magnitude and decreased lift duration of the engine valve compared to the first valve lift mode. When the term "switchable rocker arm" is used herein, by itself, it includes both types.

A typical switchable rocker arm includes an outer arm and an inner arm. The inner arm is movably connected to the outer arm. It can be switched by a locking member, from a coupled mode wherein the inner arm is immobilized relative to the outer arm, to a decoupled state wherein the inner arm can move relative to the outer arm. Typically, the outer arm of the switchable rocker arm is pivotally supported at a first end by the hydraulic lash adjuster. A second end of the outer arm operates against an associated engine valve for opening and closing the valve by the rotation of an associated eccentric cam lobe acting on an inner arm contact surface which may be a roller. The inner arm is connected to the outer arm for pivotal movement about the outer arm's second end with the contact surface of the inner arm disposed between the first and second ends of the outer arm. Typically, the locking member includes a locking pin disposed in a bore in the first end of the outer arm, the locking pin being selectively moved to engage the inner arm to thereby couple the inner arm to the outer arm when engaged, and decouple the inner arm from the outer arm when disengaged.

In a switchable two-step rocker arm, the outer arm typically supports a pair of rollers carried by a shaft. The rollers are positioned to be engaged by associated low-lift eccentric cam lobes that cause the outer arm to pivot about the hydraulic lash adjuster, thereby actuating an associated engine valve to a low-lift. The inner arm, in turn, is positioned to engage an associated high-lift eccentric cam lobe sandwiched between the aforementioned low-lift lobes. The switchable two-step rocker arm is then selectively switched between a coupled and a decoupled mode by the locking member. In the coupled mode, with the inner arm locked to the outer arm, the rotational movement of the central high-lift lobe is transferred from the inner arm, through the outer arm to cause pivotal movement of the rocker arm about the hydraulic lash adjuster, which in turn opens the associated valve to a high-lift. In the decoupled mode, the inner arm is no longer locked to the outer arm and is permitted to move relative to the outer arm against a lost motion spring that biases the inner arm away from the outer arm. In turn, the rollers of the outer arm engage their associated low-lift lobes. The rotational movement of the low-lift lobes is transferred directly through the outer arm, and the associated valve is reciprocated by the outer arm to a low-lift. It should be noted that high-lift and low-lift as used herein designates that high-lift encompasses one or both of greater magnitude of valve lift and greater duration of the valve being opened compared to low-lift.

A switchable deactivation rocker arm typically includes an outer arm and an inner arm. The inner arm supports a roller carried by a shaft. The roller is engaged by an eccentric lifting cam lobe for actuating an associated engine valve like the switchable two-step rocker arm, the switchable deactivation rocker arm is selectively switched between a coupled and a decoupled mode by a movable locking member. In the coupled mode, the inner arm of the switchable deactivation rocker arm is locked to the outer arm and the rotational movement of the associated lifting cam lobe is transferred from the inner arm, through the outer arm to cause pivotal movement of the rocker arm about the hydraulic lash adjuster which in turn opens the associated valve to a prescribed lift. In the decoupled mode, the inner arm becomes unlocked from the outer arm and is permitted to pivot relative to the outer arm against a lost motion spring. In the decoupled mode, the rotational movement of the lifting cam lobe is absorbed by the inner arm in lost motion and is not transferred to the outer arm. Thus, the associated valve remains closed when the switchable deactivation rocker arm is in its decoupled mode.

Unless constrained prior to installation of the switchable rocker arm in the internal combustion engine, it is possible for the inner arm to rotate sufficiently far so to allow the lost motion spring to become disassembled from the switchable rocker arm. In order to prevent the lost motion spring from becoming disassembled from the switchable rocker arm and to ensure that the inner arm is properly oriented for installation in the internal combustion engine, some switchable rocker arms have been designed to incorporate a travel limiter which limits the travel of the inner arm relative to the outer arm. Examples of switchable rocker arms with a travel limiter are shown U.S. Pat. Nos. 5,544,626; 5,653,198; 6,314,928; 6,532,920; 7,614,375; 7,798,113 7,882,814. However the known travel limiters may be costly to implement, difficult to assemble, and/or add to the overall size of the switchable rocker arm.

What is needed is a rocker arm which minimizes or eliminates one or more of the shortcomings as set forth above.

SUMMARY OF THE INVENTION

Briefly described, a rocker arm is provided for transmitting rotational motion from a camshaft to opening and closing motion of a combustion valve in an internal combustion engine. The rocker arm includes an outer arm defining a stop aperture with a stop surface; an inner arm which selectively pivots relative to the outer arm; a latching mechanism which switches the rocker arm between a coupled state in which the inner arm is prevented from pivoting relative to the outer arm past a predetermined position of the inner arm relative to the outer arm in a first direction and a decoupled state in which the inner arm pivots relative to the outer arm past the predetermined position in the first direction; a lost motion spring which biases the inner arm to pivot relative to the outer arm in a second direction which is opposite from the first direction; and a stop pin fixed to the inner arm and extending into the stop aperture such that the stop pin is circumferentially surrounded by the stop surface and such that the stop pin within the stop aperture limits the extent to which the inner arm pivots relative to the outer arm in the second direction.

A method for assembling a rocker arm for transmitting rotational motion from a camshaft to opening and closing motion of a combustion valve in an internal combustion engine is also provided where the rocker arm includes an outer arm defining a stop aperture with a stop surface; an inner arm which selectively pivots relative to the outer arm; a latching mechanism which switches the rocker arm between a coupled state in which the inner arm is prevented from pivoting relative to the outer arm past a predetermined position of the inner arm relative to the outer arm in a first direction and a decoupled state in which the inner arm pivots relative to the outer arm past the predetermined position in the first direction; a lost motion spring which biases the inner arm to pivot relative to the outer arm in a second direction which is opposite from the first direction; and a stop pin, the method comprising. The method includes passing the stop pin through the stop aperture; and fixing the stop pin to the inner arm after passing the stop pin through the stop aperture such that the stop pin extends into the stop aperture and such that the stop pin is circumferentially surrounded by the stop surface, thereby causing the stop pin within the stop aperture to limit the extent to which the inner arm pivots relative to the outer arm in the second direction.

BRIEF DESCRIPTION OF DRAWINGS

This invention will be further described with reference to the accompanying drawings in which.

DETAILED DESCRIPTION OF INVENTION

Figure 1:
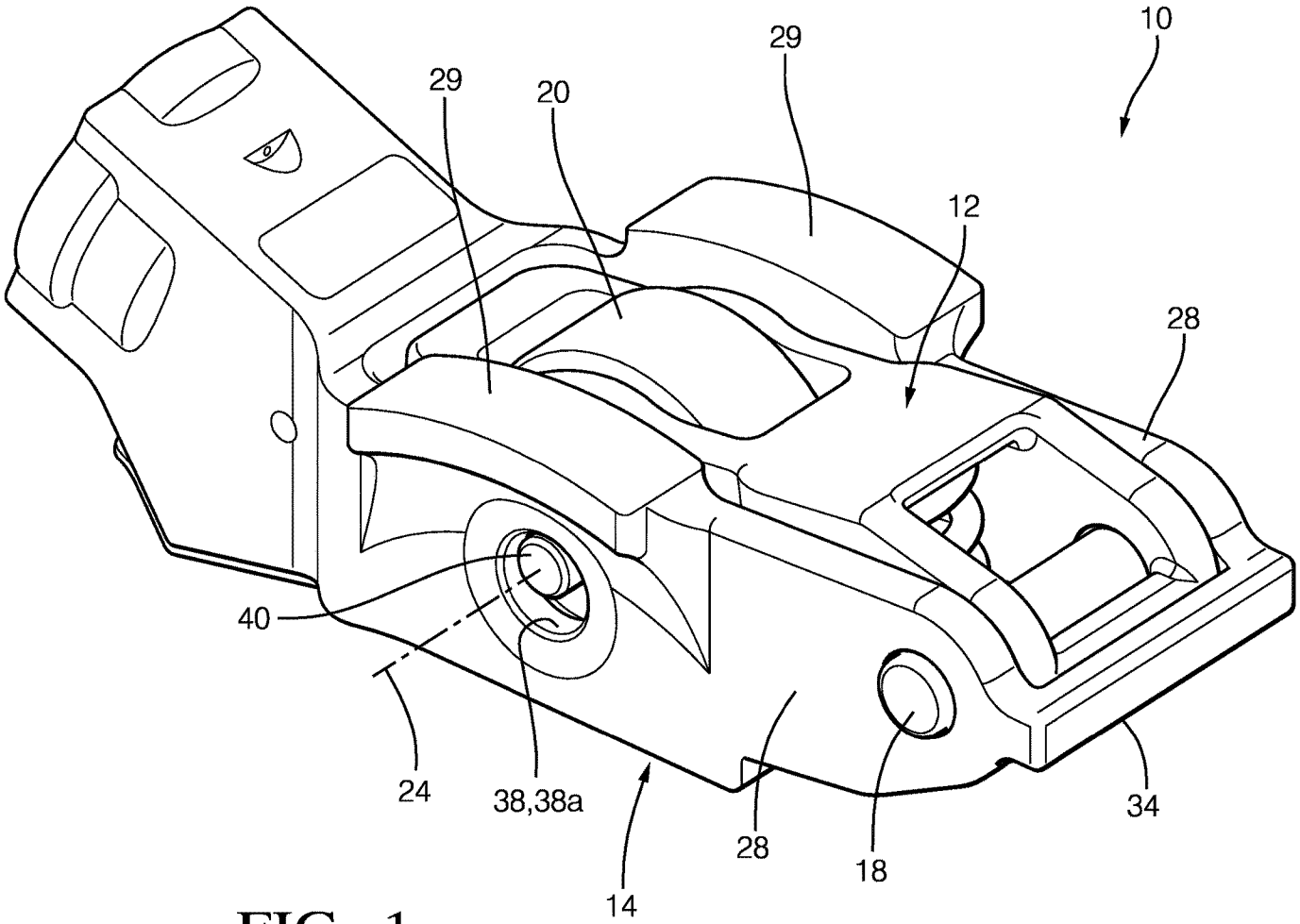
FIG. 1 is an isometric view of a rocker arm in accordance with the present invention.

Referring to FIGS. 1-5, a rocker arm 10 in accordance with the invention is illustrated where rocker arm 10 is either a two-step rocker arm or a deactivation rocker arm, which may generically be referred to as a switchable rocker arm. Rocker arm 10 is included in valve train (not shown) of an internal combustion engine (not shown) in order to translate rotational motion of a camshaft (not shown) to reciprocating motion of a combustion valve (not shown). Rocker arm 10 includes an inner arm 12 that is pivotably disposed in a central opening 16 in an outer arm 14. Inner arm 12 selectively pivots within outer arm 14 about a pivot shaft 18. Inner arm 12 includes a contact surface illustrated as a roller 20 carried by a roller shaft 22 that is supported by inner arm 12 such that roller 20 and roller shaft 22 are centered about an axis 24. Roller 20 is configured to follow a lobe of the camshaft, for example a high-lift lobe, to impart lifting motion on a respective combustion valve. A bearing 26 may rotatably support roller 20 on roller shaft 22 for following a cam lobe of a lifting cam of an engine camshaft (not shown). Bearing 26 may be, for example, a plurality of rollers or needle bearings. Roller shaft 22 is fixed to inner arm 12, by way of non-limiting example only by staking each end of roller shaft 22 in order to cause each end of roller shaft 22 to be increased in diameter to prevent removal from inner arm 12. Outer arm 14 includes two walls 28 positioned parallel to each other such that walls 28 are perpendicular to axis 24 and such that walls 28 are spaced apart from each other to define central opening 16 therebetween. Outer arm 14 also includes followers 29 such that one follower 29 is fixed to each wall 28. As shown, followers 29 may be sliding surfaces, but may alternatively be rollers. Followers 29 are configured to follow respective lobes of the camshaft, for example low-lift lobes which impart lifting motion on a respective combustion valve or null lobes which do not impart lifting motion on a respective combustion valve. A lost motion spring 30 acts between inner arm 12 and outer arm 14 to pivot inner arm 12 away from outer arm 14. A socket 32 for pivotably mounting rocker arm 10 on a lash adjuster (not shown) is included at a first end 14*a* of outer arm 14 while a pad 34 for actuating a valve stem (not shown) is included at a second end 14*b* of outer arm 14. A latching mechanism 36 disposed within outer arm 14 at first end 14*a* thereof selectively permits inner arm 12 to pivot relative to outer arm 14 about pivot shaft 18 and also selectively prevents inner arm 12 from pivoting relative to outer arm 14 about pivot shaft 18. Further details of latching mechanism 36 are described in United States Patent Application Publication No. 2015/0345343 A1 to Lee et al, the disclosure of which is hereby incorporated by reference in its entirety.

Figure 2:
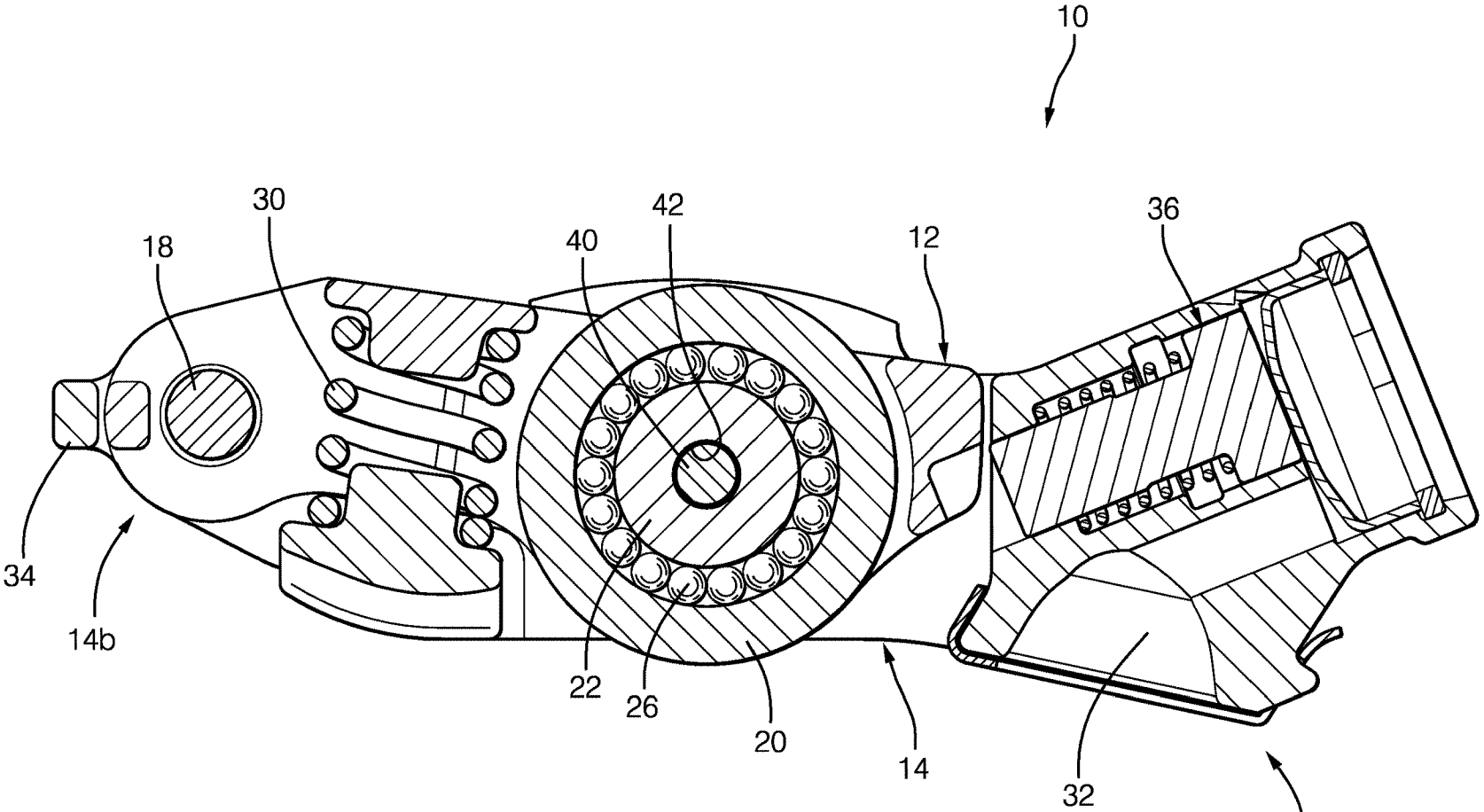
FIG. 2 is a cross-sectional view of the rocker arm of FIG. 1, taken through a first plane that is perpendicular to an axis of rotation of a central follower of the rocker arm, shown in a decoupled state.
Figure 3:
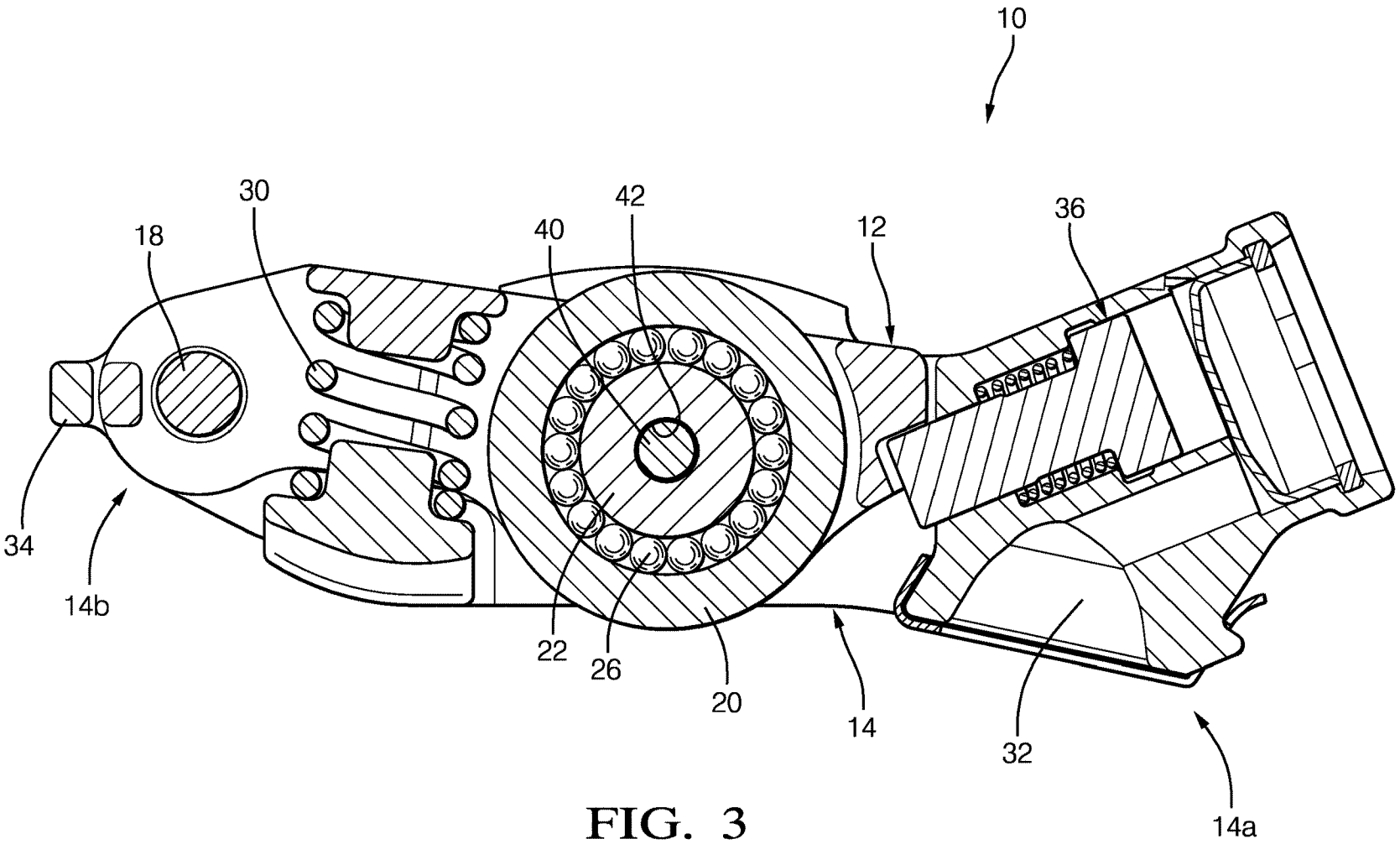
FIG. 3 is the cross-sectional view of FIG. 2, now showing the rocker arm in a coupled state.

Rocker arm 10 is selectively switched between a coupled and a decoupled state by latching mechanism 36. In the coupled state as shown in FIG. 3, inner arm 12 is prevented from pivoting relative to outer arm 14 past a predetermined position of inner arm 12 relative to outer arm 14 in a first direction, shown as clockwise in FIG. 3. In this way, in the coupled state, inner arm 12, and therefore roller shaft 22, is coupled to outer arm 14, and rotation of the lifting cam is transferred from roller 20 through roller shaft 22 to pivotal movement of outer arm 14 about the lash adjuster which, in turn, reciprocates the associated valve. In the decoupled state as shown in FIG. 2, inner arm 12 is able to pivot relative to outer arm 14 past the predetermined position in the first direction. In this way, in the decoupled state, inner arm 12, and therefore roller shaft 22, is decoupled from outer arm 14. Thus, roller shaft 22 does not transfer rotation of the lifting cam to pivotal movement of outer arm 14, and the associated valve is not reciprocated. Rather, inner arm 12 together with roller 20 and roller shaft 22 reciprocate within central opening 16, thereby compressing and uncompressing lost motion spring 30 in a cyclic manner such that lost motion spring 30 biases inner arm 12 to pivot relative to outer arm 14 in a second direction, shown as counterclockwise in FIG. 2, which is opposite from the first direction. As shown, latching mechanism 36 may be operated by application and release of hydraulic fluid pressure as is well known to those of ordinary skill in the art, however, alternative latching mechanisms may utilize solenoids, piezoelectric elements, or other known actuators rather than hydraulic pressure.

An arrangement of rocker arm 10 which limits the extent to which inner arm 12 is able to pivot relative to outer arm 14 in the direction which lost motion spring 30 urges inner arm 12 relative to outer arm 14 (shown as counterclockwise in FIG. 2) will now be described. As shown, each wall 28 of outer arm 14 includes a stop aperture 38 which extends therethrough from the outer surface of each wall 28 to central opening 16 such that stop aperture 38 is a closed aperture, i.e. stop aperture 38 defines a stop surface 38*a* which translates 360°. Also as shown, each stop aperture 38 may be a circle in order to facilitate ease of manufacture, for example by drilling; however, each stop aperture 38 may alternatively be other shapes. The arrangement also includes a stop pin 40 which is fixed to inner arm 12 and extends into a respective stop aperture 38. Stop pin 40 is located within stop aperture 38 such that stop surface 38*a* circumferentially surrounds stop pin 40. As used herein, circumferentially surrounds is defined to indicate that to the extent stop pin 40 is located within stop aperture 38, stop surface 38*a* surrounds stop pin 40 for 360° in a plane that is perpendicular to axis 24. Stop aperture 38 is sized to allow stop pin 40 to reciprocate with inner arm 12 when latching mechanism 36 is positioned to decouple inner arm 12 from outer arm 14; however, stop aperture 38 provides a surface, namely stop surface 38*a*, which limits the extent to which inner arm 12 is able to pivot relative to outer arm 14 in the direction which lost motion spring 30 urges inner arm 12 relative to outer arm 14 (shown as counterclockwise in FIG. 2). Stop pin 40 is fixed to inner arm 12 by way of a stop pin bore 42 defined in roller shaft 22 such that stop pin 40 mates with stop pin bore 42 in an interference fit, thereby preventing relative movement between stop pin 40 and roller shaft 22, including in a direction parallel to axis 24. However, it should be understood that in addition to or in alternative to an interference fit between stop pin 40 and stop pin bore 42, adhesives, metallurgical bonding, mechanical fastening arrangements such as screw threads, or mechanical fasteners such as screws may be used to prevent relative movement between stop pin 40 and roller shaft 22. Stop pin bore 42 extends parallel to axis 24, and as shown, may extend entirely through roller shaft 22 parallel to axis 24. Furthermore, stop pin bore 42 is preferably concentric to roller shaft 22, i.e. stop pin bore 42 is centered about axis 24; however, it is possible for stop pin bore 42 and stop pin 40 to be radially offset from axis 24. Stop pin bore 42 preferably includes a counterbore 44 at each end of stop pin bore 42. When roller shaft 22 is staked to inner arm 12, counterbore 44 accommodates any distortion at the end of roller shaft 22 which could affect the positioning of stop pin 40 or the magnitude of interference fit between stop pin 40 and stop pin bore 42 since stop pin 40 is installed within stop pin bore 42 after roller shaft 22 is staked to inner arm 12 as will be described in greater detail later.

A method for assembling rocker arm 10 will now be described. In a first step, latching mechanism 36 is installed in outer arm 14. In a second step subsequent to installation of latching mechanism 36 in outer arm 14, roller shaft 22, bearing 26, and roller 20 of known outside diameter are assembled to inner arm 12; however, roller shaft 22 is not staked to inner arm 12. Next, inner arm 12 together with roller shaft 22, bearing 26, and roller 20 is positioned within central opening 16 of outer arm 14. Pivot shaft 18 is installed in inner arm 12 and outer arm 14 to limit relative movement between inner arm 12 and outer arm 14 to pivoting movement about pivot shaft 18. Next, latching mechanism 36 is positioned to the coupled state as shown in FIG. 3 and a measurement is taken to find the height of roller 20 relative to socket 32 and pad 34 in order to determine the appropriate size of roller 20 that is needed to fall within a predetermined tolerance range. Based on the measurement, a determination is made if roller 20 that was selected is appropriate in size or if roller 20 needs to be larger or smaller. Subsequent to determining the size that roller 20 needs to be, pivot shaft 18 and inner arm 12 are removed. If it has been determined that roller 20 needs to be of a different size than originally selected, roller 20 of appropriate size is chosen and used to replace the originally selected roller 20; however, if the originally selected roller 20 is of appropriate size, no change is required. It should be noted that replacement of roller 20 may include replacing roller shaft 22 and bearing 26 as well. After roller 20 of appropriate size is installed on inner arm 12, roller shaft 22 is staked, i.e. each end of roller shaft 22 is deformed to prevent removal of roller shaft 22 from inner arm 12, in order to retain roller 20, roller shaft 22, and bearing 26 to inner arm 12. Next, inner arm 12 together with roller 20, roller shaft 22, and bearing 26 is positioned within central opening 16 of outer arm 14 and pivot shaft 18 is installed to retain inner arm 12 to outer arm 14. Pivot shaft 18 may be fixed to inner arm 12 and outer arm 14, by way of non-limiting example only, by staking opposing ends of pivot shaft 18. However, pivot shaft 18 may alternatively be fixed to inner arm 12 and outer arm 14 by interference fit, threaded fasteners, or clips. It should be noted that at this point, inner arm 12 does not include stop pin 40. After pivot shaft 18 is fixed to inner arm 12 and outer arm 14, inner arm 12 is pivoted relative to outer arm 14 about pivot shaft 18 sufficiently far to allow positioning of lost motion spring 30 between inner arm 12 and outer arm 14. After lost motion spring 30 is appropriately positioned between inner arm 12 and outer arm 14, inner arm 12 is pivoted relative to outer arm 14 until stop pin bore 42 is aligned with stop aperture 38 and then stop pin 40 is installed within stop pin bore 42 of roller shaft 22 by passing stop pin 40 through stop aperture 38. Preferably, installation of stop pin 40 within stop pin bore 42 includes press-fitting stop pin 40 within stop pin bore 42; however, alternative retention methods of stop pin 40 to stop pin bore 42 may be utilized as described previously. Now with stop pin 40 fixed to roller shaft 22, pivotal motion of inner arm 12 relative to outer arm 14 in the direction which lost motion spring 30 urges inner arm 12 relative to outer arm 14 (shown as counterclockwise in FIG. 2) is limited, thereby preventing disassembly of lost motion spring 30 from rocker arm 10 and also thereby keeping inner arm 12 positioned relative to outer arm 14 in order to facilitate later assembly of rocker arm 10 into a valve train system of an internal combustion engine.

Figure 4:
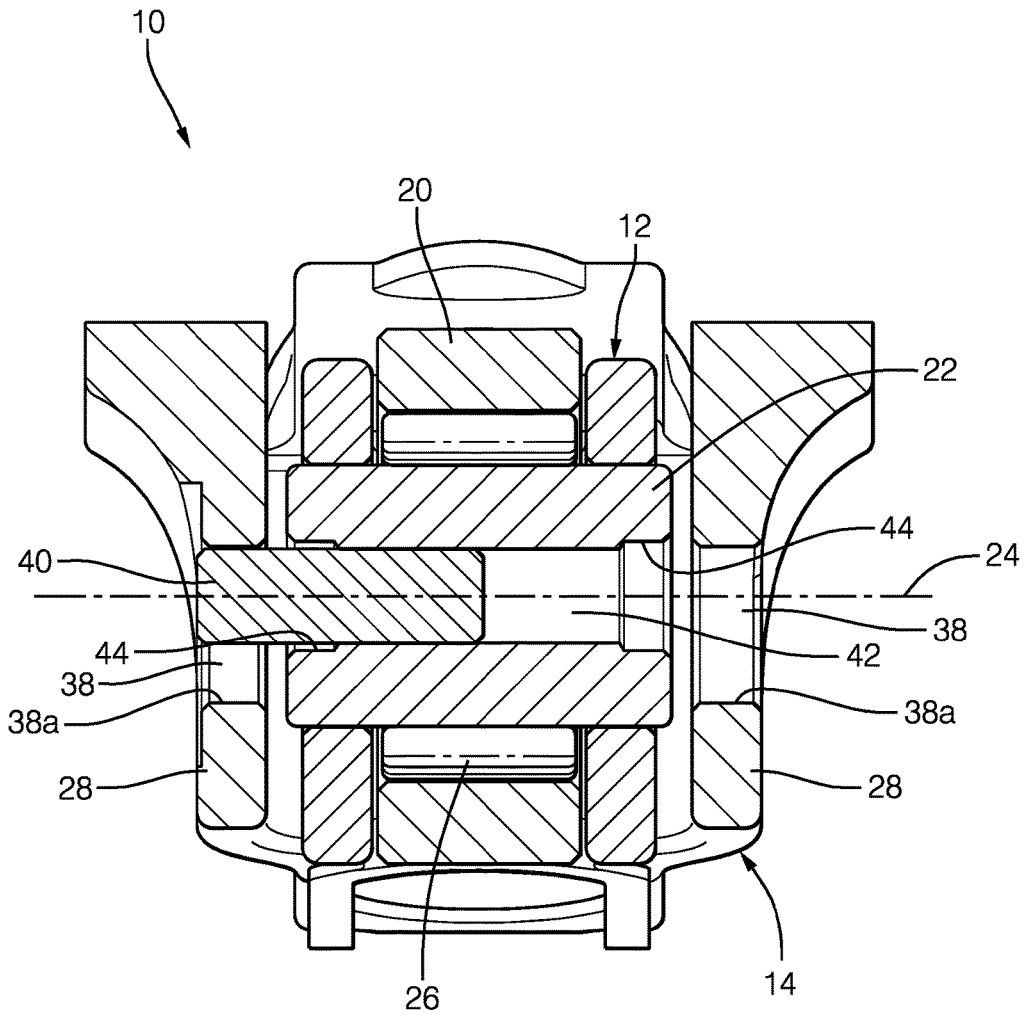
FIG. 4 is a cross-sectional view of the rocker arm of FIG. 1 taken through a second plane that is perpendicular to the first plane of FIG. 2 such that the second plane is parallel to the axis of rotation of the central follower.
Figure 5:
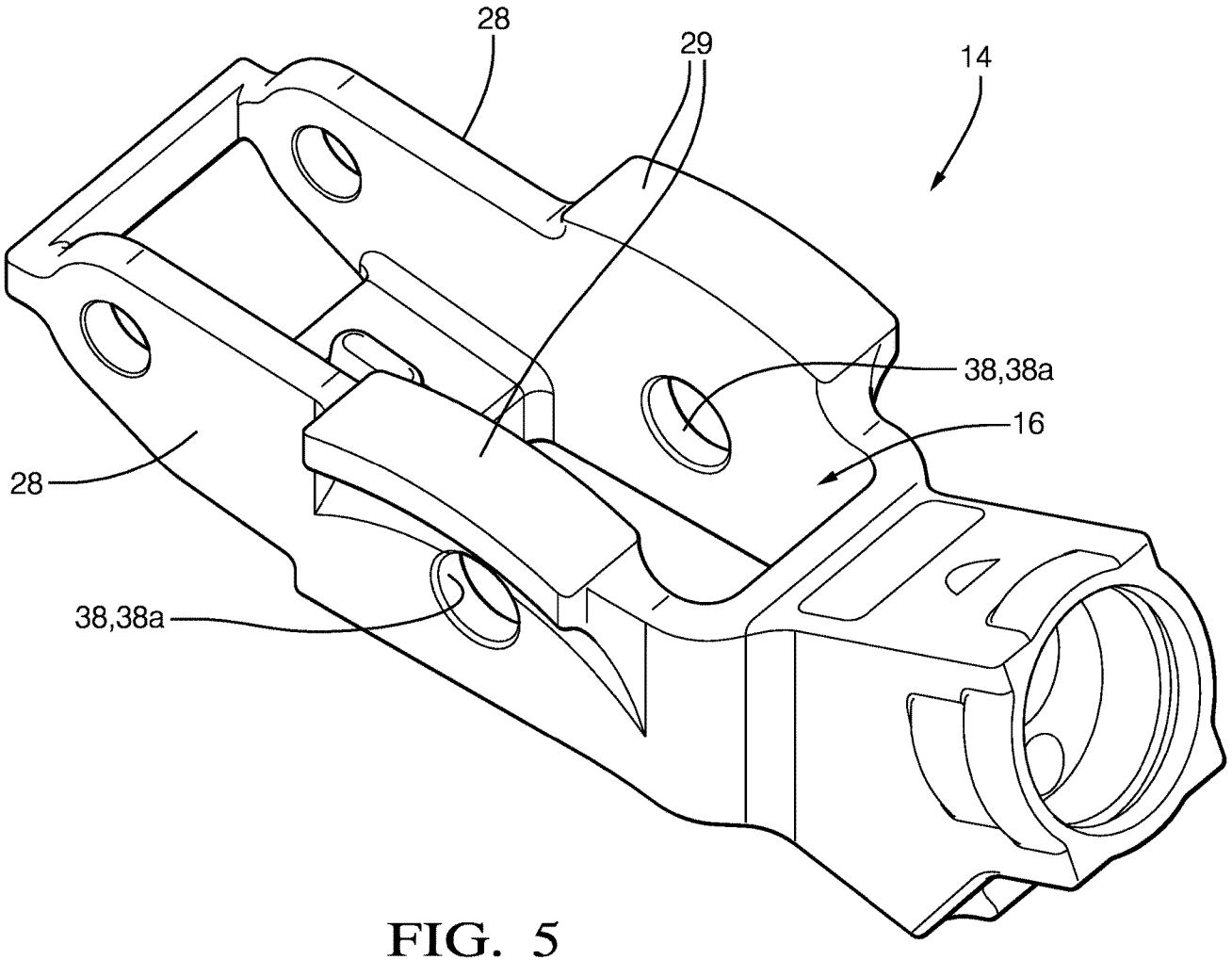
FIG. 5 is an isometric view of an outer arm of the rocker arm of FIG. 1.
Figure 6:
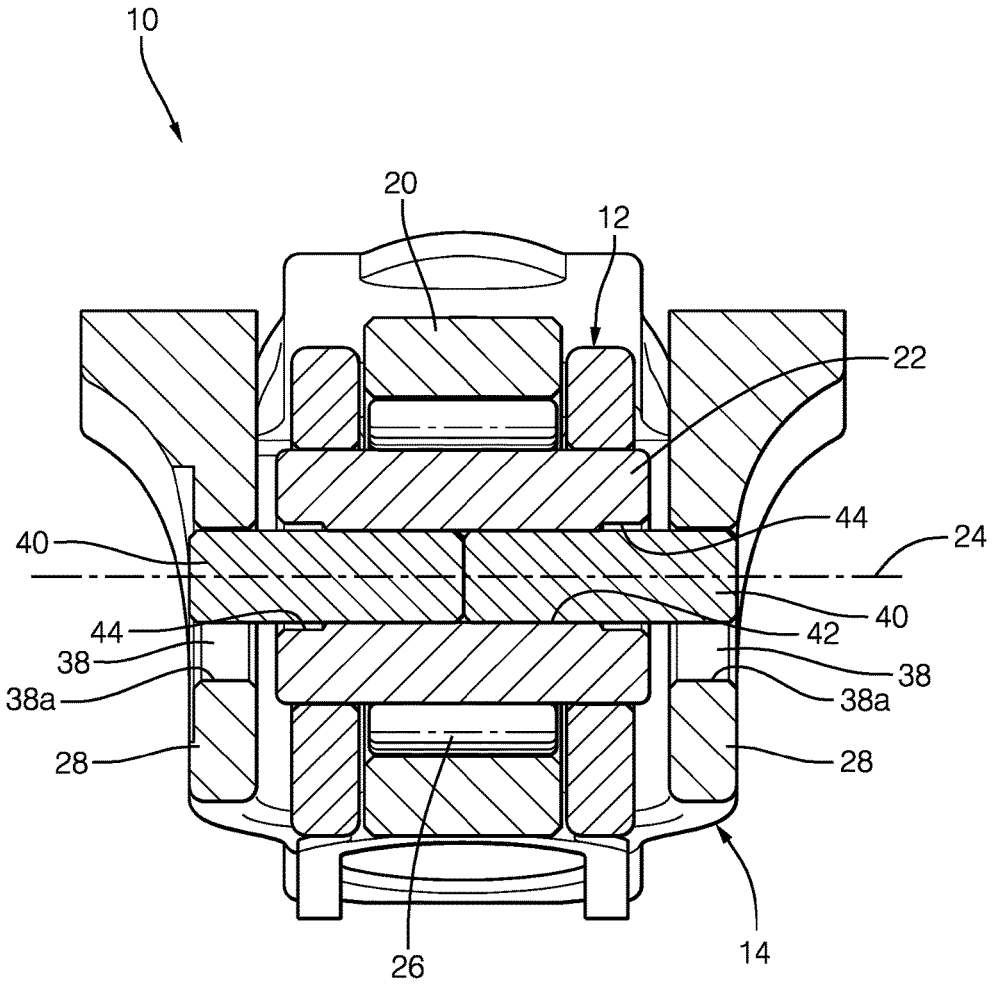
FIGS. 6-9 are each the cross-sectional view of FIG. 4 showing alternative constructions.
Figure 7:
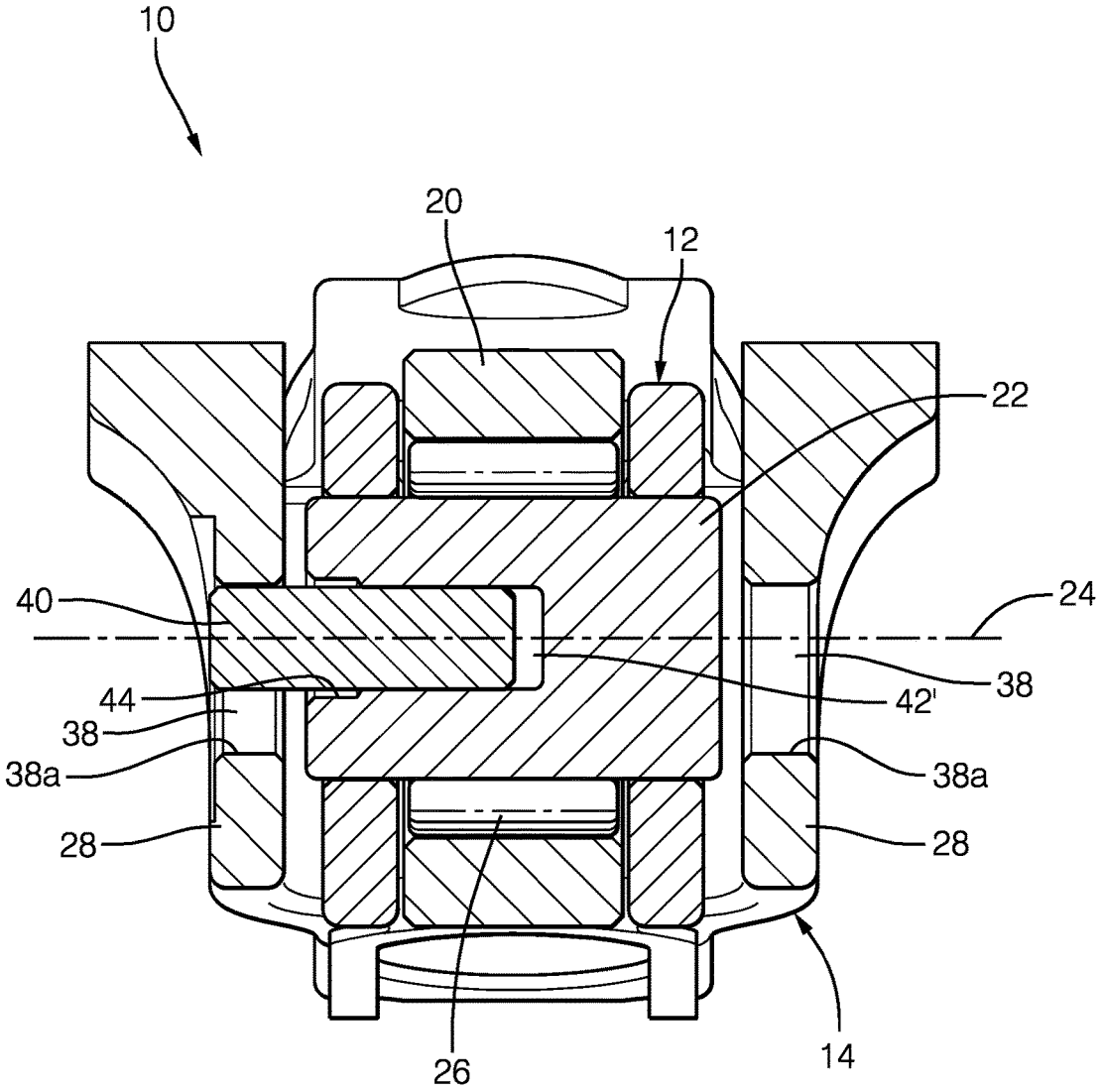
Figure 8:
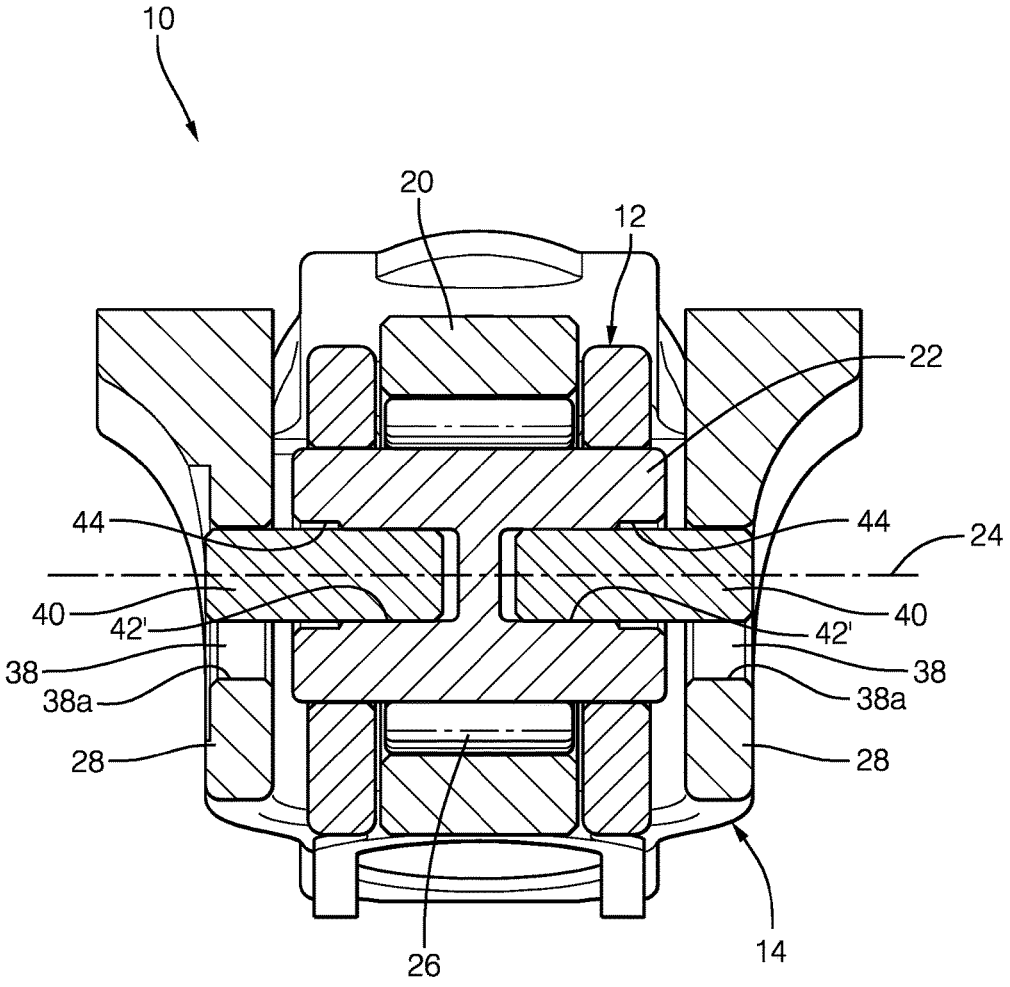
Figure 9:
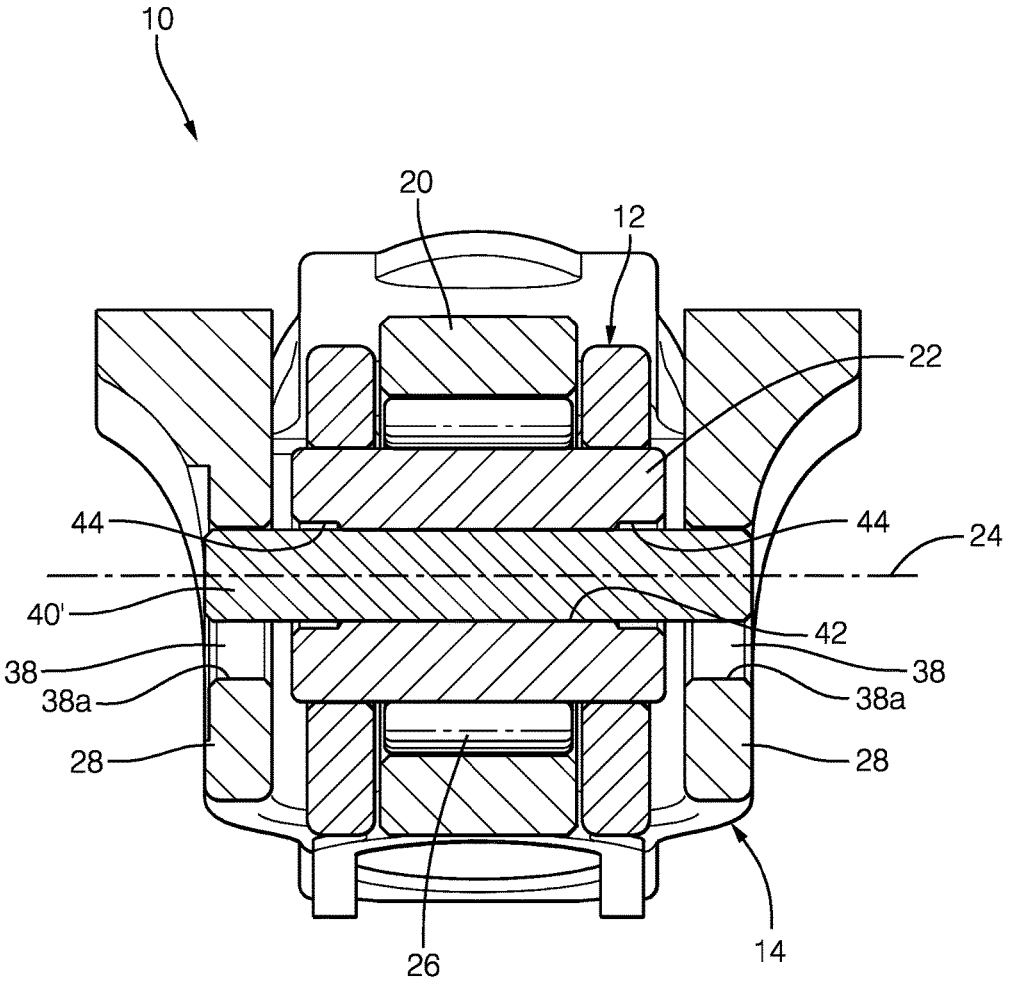

While rocker arm 10 has been described herein as having as single stop pin 40 which extends into only one stop aperture 38 as shown best in FIG. 4, it should now be understood that alternative arrangements may be possible. In a first alternative as shown in FIG. 6, two stop pins 40 may be provided such that one stop pin 40 is located within one end of stop pin bore 42 and extends into one stop aperture 38 while the other stop pin 40 is located within the other end of stop pin bore 42 and extends into the other stop aperture 38. In a second alternative as shown in FIG. 7, stop pin bore 42 is replaced with stop pin bore 42' which does not extend entirely through roller shaft 22, but instead is a blind bore. It should be noted that the arrangements of FIGS. 4 and 7 may be further modified such that only one wall 28 of outer arm 14 includes stop aperture 38. In a third alternative shown in FIG. 8, which is a cross between the alternatives of FIG. 6 and FIG. 7, a stop pin bore 42' is provided on each end of roller shaft 22 such that a stop pin 40 is located within each stop pin bore 42'. In a fourth alternative as shown in FIG. 9, stop pin 40 is replaced with stop pin 40' such that stop pin 40' extends entirely through stop pin bore 42 and such that one end of stop pin 40' extends into one stop aperture 38 while the other end of stop pin 40' extends into the other stop aperture 38.

Rocker arm 10 and the assembly method of rocker arm 10 described herein provides a robust and economical approach for limiting the extent to which inner arm 12 is able to pivot relative to outer arm 14, particularly prior to rocker arm 10 being installed in the internal combustion engine. Since stop pin 40 is installed after inner arm 12 is assembled to outer arm 14, the appropriate sized of roller 20 is able to be easily determined and roller 20 can be easily substituted for roller 20 of appropriate size if needed prior to inner arm 12 being fixed to outer arm 14. Furthermore, stop pin 40 is minimal in cost and requires simple manufacturing techniques to be accommodated in rocker arm 10.

While this invention has been described in terms of preferred embodiments thereof, it is not intended to be so limited, but rather only to the extent set forth in the claims that follow.

We claim:

1. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction;

a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft; and wherein said roller shaft defines a stop pin bore within which said stop pin is received in fixed relationship which prevents movement of said stop pin relative to said roller shaft.

2. A rocker arm as in claim 1 wherein said stop pin is received within said stop pin bore in an interference fit relationship.

3. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction;

a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft; and wherein said stop pin is centered about said axis.

4. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction;

a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft;

wherein said outer arm comprises a first wall and a second wall such that a central opening is defined between said first wall and said second wall;

wherein said inner arm is disposed between said first wall and said second wall; and wherein said roller shaft defines a stop pin bore within which said stop pin is received in fixed relationship which prevents movement of said stop pin relative to said roller shaft.

5. A rocker arm as in claim 4 wherein said stop pin is received within said stop pin bore in an interference fit relationship.

6. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction; and a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft;

wherein said outer arm comprises a first wall and a second wall such that a central opening is defined between said first wall and said second wall;

wherein said inner arm is disposed between said first wall and said second wall;

wherein said stop aperture extends through said first wall of said outer arm;

wherein said stop pin is a first stop pin fixed to a first axial end of said roller shaft, said stop aperture is a first stop aperture, and said stop surface is a first stop surface;

wherein said rocker arm further comprises a second stop aperture extending through said second wall of said outer arm and having a second stop surface;

wherein said rocker arm further comprises a second stop pin fixed to a second axial end of said roller shaft which is opposed to said first axial end of said roller shaft, said second stop pin extending into said second stop aperture such that said second stop pin is circumferentially surrounded by said second stop surface and such that said second stop pin within said second stop aperture limits the extent to which said inner arm pivots relative to said outer arm in said second direction;

wherein said roller shaft defines a stop pin bore which extends through said roller shaft such that said first stop pin is received within said stop pin bore in fixed relationship which prevents movement of said first stop pin relative to said roller shaft and such that said second stop pin in is received within said stop pin bore in fixed relationship which prevents movement of said second stop pin relative to said roller shaft.

7. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction;

a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft;

wherein said outer arm comprises a first wall and a second wall such that a central opening is defined between said first wall and said second wall;

wherein said inner arm is disposed between said first wall and said second wall;

wherein said stop aperture extends through said first wall of said outer arm;

wherein said stop pin is a first stop pin fixed to a first axial end of said roller shaft, said stop aperture is a first stop aperture, and said stop surface is a first stop surface;

wherein said rocker arm further comprises a second stop aperture extending through said second wall of said outer arm and having a second stop surface;

wherein said rocker arm further comprises a second stop pin fixed to a second axial end of said roller shaft which is opposed to said first axial end of said roller shaft, said second stop pin extending into said second stop aperture such that said second stop pin is circumferentially surrounded by said second stop surface and such that said second stop pin within said second stop aperture limits the extent to which said inner arm pivots relative to said outer arm in said second direction;

wherein said roller shaft defines a first stop pin bore which extends into said roller shaft from said first axial end of said roller shaft such that said first stop pin is received within said first stop pin bore in fixed relationship which prevents movement of said first stop pin relative to said roller shaft; and wherein said roller shaft defines a second stop pin bore which extends into said roller shaft from said second axial end of said roller shaft such that said second stop pin is received within said second stop pin bore in fixed relationship which prevents movement of said second stop pin relative to said roller shaft.

8. A rocker arm for transmitting rotational motion from a camshaft to opening and closing motion of a combustion valve in an internal combustion engine, said rocker arm comprising:

an outer arm defining a stop aperture with a stop surface;

an inner arm which selectively pivots relative to said outer arm;

a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction;

a lost motion spring which biases said inner arm to pivot relative to said outer arm in a second direction which is opposite from said first direction;

a stop pin fixed to said inner arm and extending into said stop aperture such that said stop pin is circumferentially surrounded by said stop surface and such that said stop pin within said stop aperture limits the extent to which said inner arm pivots relative to said outer arm in said second direction;

a roller shaft extending along an axis and supported by said inner arm such that said roller shaft pivots with said inner arm relative to said outer arm; and a roller which circumferentially surrounds said roller shaft such that said roller rotates relative to said roller shaft about said axis;

wherein said stop pin is fixed to said roller shaft;

wherein said outer arm comprises a first wall and a second wall such that a central opening is defined between said first wall and said second wall;

wherein said inner arm is disposed between said first wall and said second wall;

wherein said stop aperture extends through said first wall of said outer arm;

wherein said stop aperture is a first stop aperture and said stop surface is a first stop surface;

wherein said rocker arm further comprises a second stop aperture extending through said second wall of said outer arm and having a second stop surface;

wherein said stop pin extends into said second stop aperture such that said stop pin is circumferentially surrounded by said second stop surface and such that said stop pin within said second stop aperture limits the extent to which said inner arm pivots relative to said outer arm in said second direction; and wherein said roller shaft defines a stop pin bore which extends through said roller shaft such that said stop pin is received within said stop pin bore in fixed relationship which prevents movement of said stop pin relative to said roller shaft.

9. A method for assembling a rocker arm for transmitting rotational motion from a camshaft to opening and closing motion of a combustion valve in an internal combustion engine, said rocker arm comprising an outer arm defining a stop aperture with a stop surface; an inner arm which selectively pivots relative to said outer arm; a latching mechanism which switches said rocker arm between a coupled state in which said inner arm is prevented from pivoting relative to said outer arm past a predetermined position of said inner arm relative to said outer arm in a first direction and a decoupled state in which said inner arm pivots relative to said outer arm past said predetermined position in said first direction; a lost motion spring which biases said inner arm to pivot relative to said outer arm in a second direction which is opposite from said first direction; and a stop pin, said method comprising:

passing said stop pin through said stop aperture; and fixing said stop pin to said inner arm after passing said stop pin through said stop aperture such that said stop pin extends into said stop aperture and such that said stop pin is circumferentially surrounded by said stop surface, thereby causing said stop pin within said stop aperture to limit the extent to which said inner arm pivots relative to said outer arm in said second direction;

wherein said outer arm comprises a first wall and a second wall such that a central opening is defined between said first wall and said second wall; and said inner arm is disposed between said first wall and said second wall, said rocker arm further comprising a roller shaft extending along an axis and supported by said inner arm such that said roller shaft pivots with said inner arm relative to said outer arm and a roller which circumferentially surrounds said roller shaft such that said roller rotates relative to said roller shaft about said axis, wherein said step of passing said stop pin through said stop aperture includes passing said stop pin through one of said first wall and said second wall; and wherein said step of fixing said stop pin to said inner arm includes inserting said stop pin in a stop pin bore of said roller shaft in an interference fit relationship.

* * * * *